US006694901B2

(12) United States Patent
Filges et al.

(10) Patent No.: US 6,694,901 B2
(45) Date of Patent: Feb. 24, 2004

(54) BUTTONHOLE SEWING MACHINE

(75) Inventors: Karsten Filges, Bielefeld (DE); Theodor Janocha, Bielefeld (DE); Jochen Fischer, Detmold (DE)

(73) Assignee: Dürkopp Adler Aktiengesellschaft, Bielefeld (DE)

( * ) Notice: Subject to any disclaimer, the term of this patent is extended or adjusted under 35 U.S.C. 154(b) by 0 days.

(21) Appl. No.: 10/446,348

(22) Filed: May 28, 2003

(65) Prior Publication Data

US 2003/0226485 A1 Dec. 11, 2003

(30) Foreign Application Priority Data

Jun. 10, 2002 (DE) ..... 102 25 511

(51) Int. Cl.[7] ..... D05B 3/08
(52) U.S. Cl. ..... 112/68; 112/70; 112/130

(58) Field of Search ..... 112/68, 70, 65, 112/67, 130

(56) References Cited

U.S. PATENT DOCUMENTS

| | | | | |
|---|---|---|---|---|
| 6,095,066 | A | 8/2000 | Nöltge et al. | |
| 6,220,192 | B1 | 4/2001 | Kähler et al. | |
| 6,237,515 | B1 * | 5/2001 | Noltge | 112/68 |

* cited by examiner

*Primary Examiner*—Peter Nerbun
(74) *Attorney, Agent, or Firm*—McGlew and Tuttle, P.C.

(57) ABSTRACT

A buttonhole sewing machine comprises a buttonhole cutting device which includes a knife and a cutting block unit with several cutting blocks, one of which at a time being movable into a position of cooperation with the knife. The cutting blocks are mounted on an anvil that is stationarily joined to the sewing machine. The knife is movable from above against the anvil.

10 Claims, 5 Drawing Sheets

BUTTONHOLE SEWING MACHINE

BACKGROUND OF THE INVENTION

1. Field of the Invention

The invention relates to a buttonhole sewing machine, comprising a needle which is drivable in up and down reciprocation; an x-y table, which is displaceable by an x drive in an x direction and by a y drive in a y direction, and which supports at least a work piece clamp; and a buttonhole sewing device, which is substantially disposed downstream of the needle in the y direction, which comprises a cutter with a knife, which comprises a cutting block unit of several cutting blocks, one of which at a time being movable into a position of cooperation with the knife, and which is provided with a cutting drive.

2. Background Art

A buttonhole sewing machine of the generic type is known from U.S. Pat. No. 6,220,192 B1. In this case, a knife is stationarily, but replaceably mounted on the base plate of the sewing machine. Several cutting blocks are mounted above the knife on a rotary support that is drivable in up and down reciprocation; the cutting blocks can be moved around an axis that extends in the y direction selectively into a position in which a cutting block cooperates with the knife. Pivoting the cutting blocks and setting the support in a given position of a cutting block needs extensive constructional requirements.

SUMMARY OF THE INVENTION

It is an object of the invention to embody a buttonhole sewing machine of the generic type such that the constructional requirements for the cutting device are as little as possible.

According to the invention, this object is attained by features wherein an anvil which supports at least two cutting blocks that are adjustable in the x direction is stationarily joined to the sewing machine; and wherein the knife is movable from above against the anvil. By a linear motion which can be extremely short, only extending over the width of a cutting block, the cutting blocks can selectively be moved into a position in which they engage with the knife which is only movable in a straight line. The anvil is mounted on the base plate, having only a single support that is movable only in a single direction, namely the x direction, whereas the knife only makes a vertical linear motion.

Details of the invention will become apparent from the ensuing description of a exemplary embodiment, taken in conjunction with the drawing.

DESCRIPTION OF A PREFERRED EMBODIMENT

Figure 1:
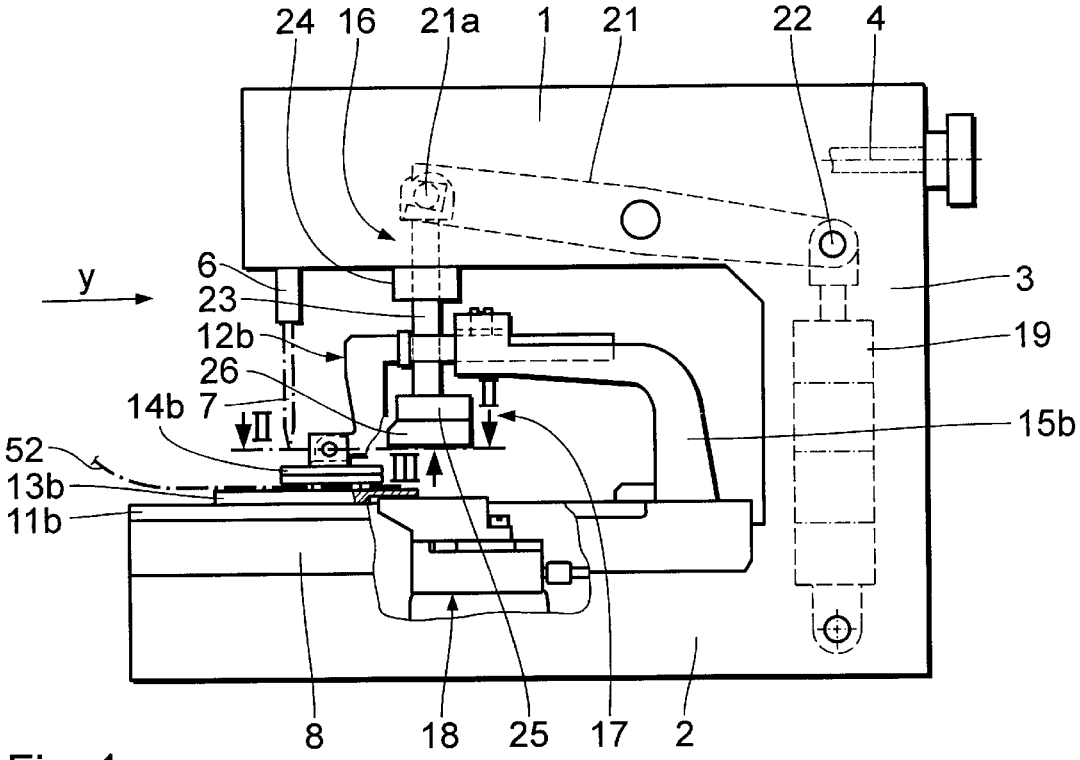
FIG. 1 is a lateral view of a buttonhole sewing machine.
Figure 2:
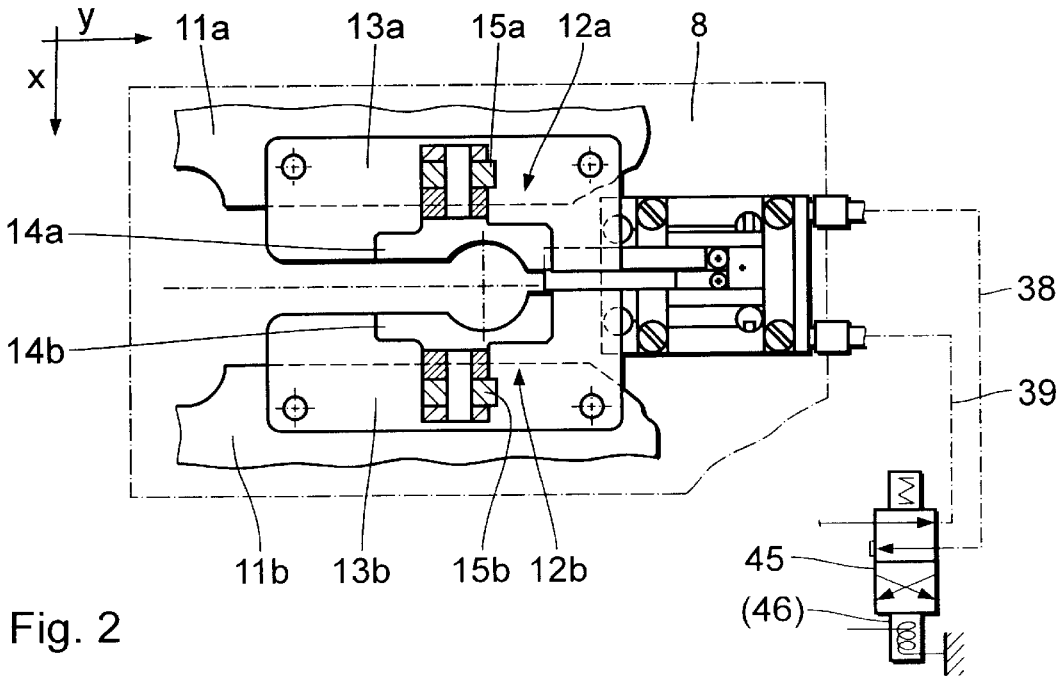
FIG. 2 is a partial horizontal sectional view of the sewing machine on the line II—II of FIG. 1 on an enlarged scale as compared to FIG. 1.
Figure 4:
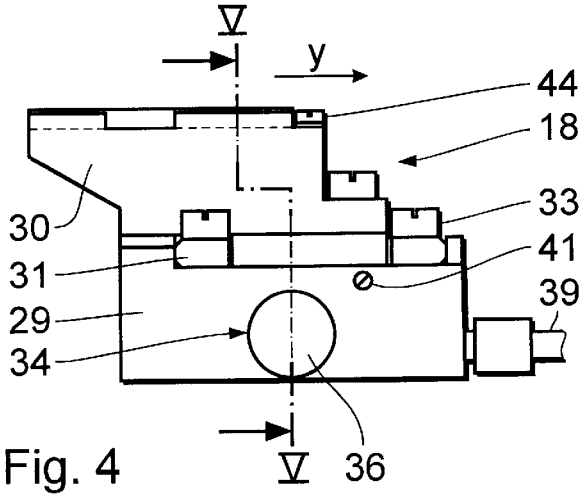
FIG. 4 is a lateral view of an anvil on an enlarged scale as compared to FIG. 1.
Figure 5:
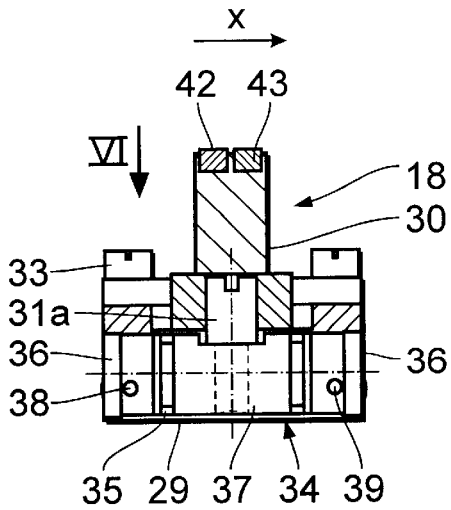
FIG. 5 is a vertical cross-sectional view of the anvil on the line V—V of FIG. 4.
Figure 7:
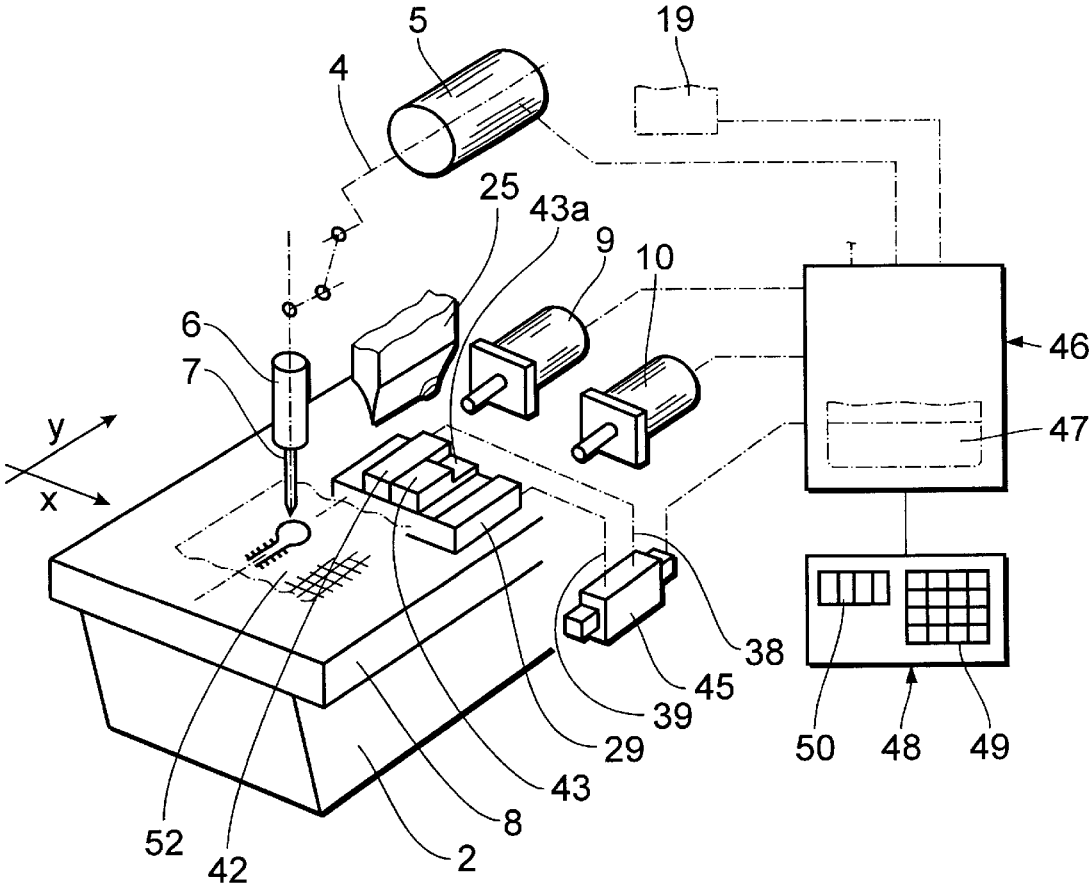
FIG. 7 is a perspective view of part of the buttonhole sewing machine, including the linkage in circuit of the various drives with a control unit and an operating unit.

As seen in FIG. 1, a buttonhole sewing machine is C-shaped, having a top arm 1, a bottom base plate 2 in the form of a casing and an approximately vertical standard 3 that unites the two. An arm shaft 4 is conventionally lodged in the arm 1; it is drivable by a motor 5 which is only roughly outlined in FIG. 7. The actuation of a vertically displaceable needle bar 6 with a needle 7 and a jogging drive therefor are customarily derived from the arm shaft 4.

Disposed on the base plate 2 is an x-y table 8 which is a cross slide that is movable in two horizontal coordinate directions, namely the x and the y direction. The x-y table 8 is of conventional design as known for example from U.S. Pat. No. 6,095,066 A. Actuation of the x-y table 8 takes place by drives roughly outlined in FIG. 7, namely an x drive 9 and a y drive 10, which are electric positioning motors, preferably stepper motors, or variable speed D.C. motors.

A two-piece supporting plate 11*a*, 11*b* is disposed on the x-y table 8. One of the two sectional supporting plates 11*a* or 11*b* can be supported on the x-y table 8 for displacement in the x direction, whereas the other sectional supporting plate 11*b* or 11*a* is non-displaceably fixed on the x-y table 8, which is not shown in detail.

A work piece clamp 12*a* and 12*b* is mounted on each sectional supporting plate 11*a* and 11*b*, having a sectional bearing plate 13*a* and 13*b* which is mounted on the respective sectional supporting plate 11*a* and 11*b*, with a clamping plate 14*a* and 14*b* being allocated thereto. The clamping plates 14*a*, 14*b* are mounted on double-armed bearing levers 15*a*, 15*b*.

Details of the structure and operation of the work piece clamps 12*a*, 12*b* can be taken from DE 102 16 809 C1 (corresponding to U.S. Ser. No. 10/410,466, filed Apr. 9, 2003) to which reference is made in this regard.

Figure 3:
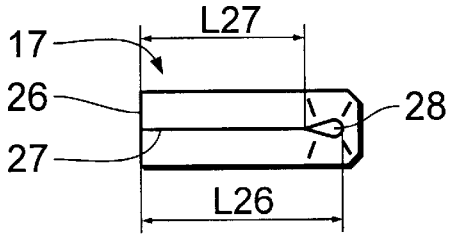
FIG. 3 is a view of a knife corresponding to the arrow III of FIG. 1.

Downstream of the needle bar 6, seen in the y direction, provision is made for a buttonhole cutting device 16 which substantially consists of an upper, drivable cutter 17 and a lower anvil 18. The upper cutter 17 has a cutting drive 19, details of which will be described below; one end of the cutting drive 19 is fixed in the base plate 2 by means of a joint 20. The other top end of the drive 19 is connected to a double-armed lever 21 by means of a joint 22, the lever 21 being articulated by another joint 21 a to a driving rod 23 which is vertically displaceable in at least one guide bearing 24 that is mounted on the arm 1. The lower end of the driving rod 23 is provided with a knife head 25, to the bottom side of which a knife 26, seen in FIG. 3, is replaceably attached. As seen in FIG. 3, the knife 26 has a straight cutting edge 27 and an eye cutting edge 28. The straight cutting edge 27 has a length $L_{27}$, whereas the entire knife 26 has a length $L_{26}$, comprising the straight cutting edge 27 and the eye cutting edge 28.

The anvil 18 has a base body 29 fixed in the base plate 2. A support 30 is disposed on the base body 29; it is displaceable in the x direction. It is held by strips 31, 32 on the base body 29, the strips 31, 32 being fixed to the base body 29 by screws 33. A displacement drive 34 is integrated in the base body 29, which is a piston-cylinder drive pneumatically actuated on two sides. The cylinder 35 is formed by a drilled hole in the base body 29 which runs in the x direction and the ends of which are closed by covers 36. A piston 37 is displaceable in the cylinder 35, with a line 38, 39 opening into the cylinder 35 on each front end of the piston 37 and serving for compressed air supply and evacuation. The support 30 is joined to the piston 37 by means of a bolt 31*a*; it is moved by the piston 37 in the x direction, depending on whether the piston 37 is actuated by compressed air via the line 38 or 39. The two shifting motions are defined by adjustable stops 40, 41 which are formed by set-screws arranged in the base body 29.

Figure 6:
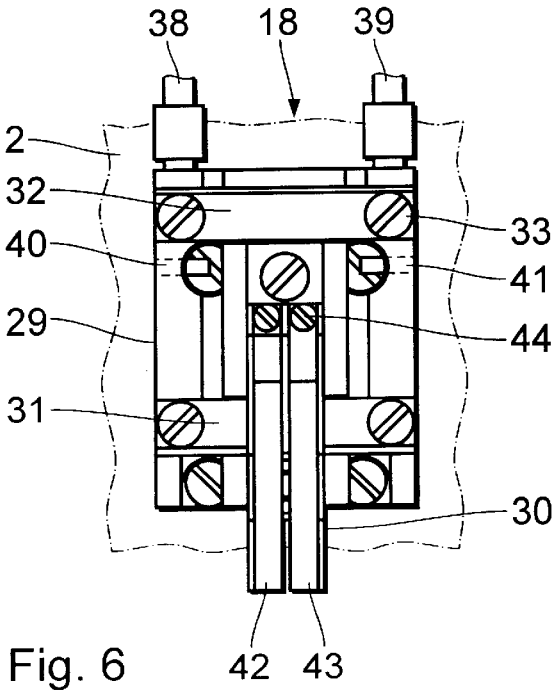
FIG. 6 is a plan view of the anvil in accordance with the arrow VI of FIG. 5.

A first cutting block 42 and a second cutting block 43 are replaceably fixed by screws 44 on the support 30. As apparent from a combination of FIG. 3 and FIG. 6, when the first cutting block 42 is underneath the knife 26, cooperating there-with, the entire knife 26, i.e. the straight cutting edge 27 and the eye cutting edge 28, is in engagement with the cutting block 42. When the second cutting block 43 is underneath the knife 26, only the straight cutting edge 27 will engage there-with; the eye cutting edge 28 does not cut. The area of the second cutting block 43 that is allocated to the eye cutting edge is provided with a recess 43*a*.

Actuating the displacement drive 34 and thus shifting the support 30 into one of the two stop positions, in which either the first cutting block 42 is underneath the knife 26 or the second cutting block 43 is underneath the knife 26, takes place by a compressed-air source (not shown) via an electromagnetically operated multiple-way valve 45.

The sewing machine is provided with a control unit 46 by which to trigger the x drive 9, the y drive 10, the multiple-way valve 45 for the displacement drive 34, the driving motor 5 of the arm shaft 4, clamping drives (not shown) for the work piece clamps 12*a*, 12*b* and the cutting drive 19. The control unit 46 comprises a memory unit 47. Further provision is made for an operating unit 48 with a keyboard 49 and a display 50.

Figure 8:
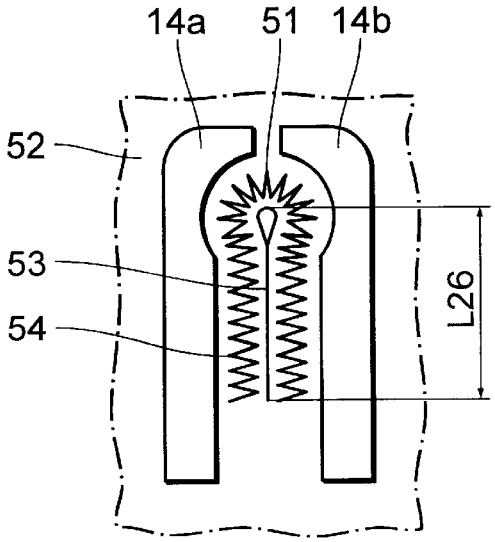
FIG. 8 is a plan view of a work piece with an eye type buttonhole held in a work piece clamp.
Figure 9:
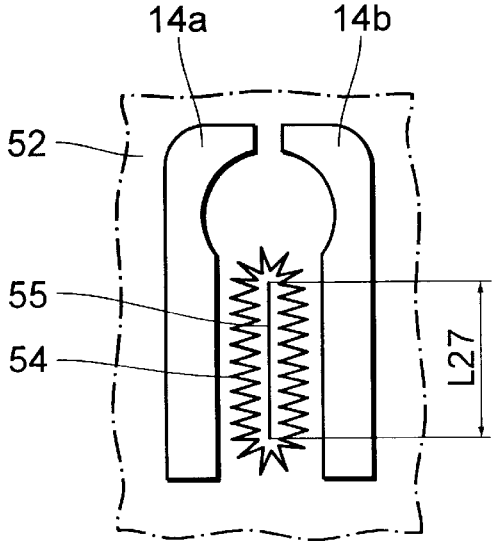
FIG. 9 is a plan view of a work piece with a simple buttonhole held in a work piece clamp.

The mode of operation will become apparent from FIGS. 8 and 9. After a work piece 52 has been provided with an eye-type buttonhole seam 51, the work piece 52 is transported by the x-y table 8 in the y direction into the cutting device 16. The first cutting block 42 is underneath the knife 26. The cutting drive 19 is operated. The entire knife 26 cooperates for cutting with the first cutting block 42 which forms a mating surface so that the straight cutting edge 27 and the eye cutting edge 28 cut an eye-type buttonhole 53 of a length $L_{26}$.

If however a simple buttonhole has been sewn that has stitched transverse locks instead of an eye, a so-called linen buttonhole, then the second cutting block 43 is moved under the knife 26 by corresponding actuation of the displacement drive 34. The work piece 52 with the buttonhole seam 54 is moved over the second cutting block 43. By actuation of the cutting drive 19, only the straight cutting edge 27 of the knife is in contact with the cutting block 43. A straight buttonhole 55 of a length $L_{27}$ is cut.

Figure 11:
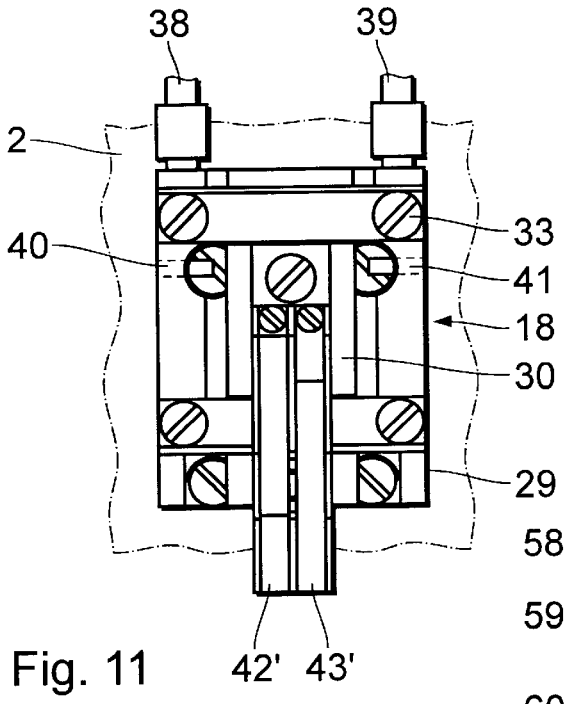
FIG. 11 is a plan view of an anvil suited to the knife of FIG. 10 in an illustration according to FIG. 6.
Figure 10:
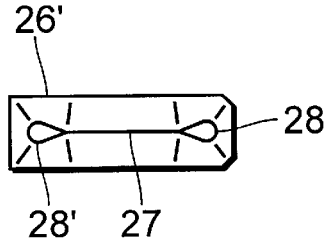
FIG. 10 is a plan view of a modified embodiment of a knife in an illustration corresponding to FIG. 3.

An alternative will become apparent from FIGS. 10 and 11. In this case, the knife 26' has a central straight cutting edge 27 and an eye cutting edge 28 and 28' at each end thereof. The cutting blocks 42', 43' are designed in such a way that the first cutting block 42' is in contact with the straight cutting edge 27 and the eye cutting edge 28, whereas the second cutting block 43' is designed in such a way that it is in contact with the straight cutting edge 27 and the eye cutting edge 28'. This embodiment enables eye-type buttonholes to be produced that vary in position.

Figure 12:
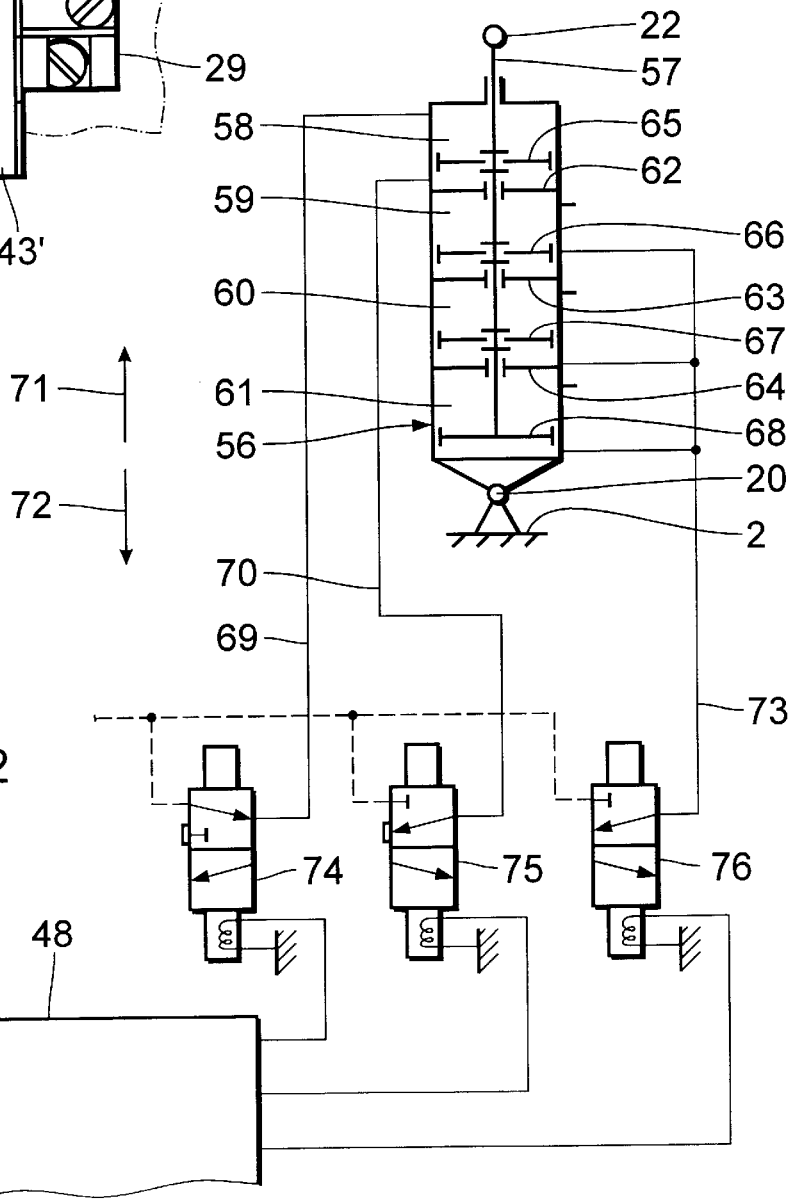
FIG. 12 is a diagrammatic view of a cutting drive for the buttonhole cutting device, including the linkage in circuit with the control unit.

The cutting drive 19 in the embodiment according to FIG. 12 is substantially formed by y multichamber cylinder 56 which is fixed in the base plate 2 by means of the joint 20. Disposed in the cutting drive 19 is a piston 57, the outer end of which is connected to the lever 21 via the joint 22. In the cylinder 56, a total of four chambers 58 to 61 are separated from each other by dividing walls 62, 63, 64, through which the piston rod 57 passes in a sealed manner. The chambers 58 to 61 are disposed one after the other over the length of the cylinder 56. A piston 65, 66, 67, 68 is disposed in each chamber; it is fixed to the piston rod 57 and sealed toward the cylinder 56. The chambers 58, 59, 60, 61 and the pistons 65 to 68 constitute four spatially successive, active linear drives. The piston 65 in the first chamber 58 is designed for bilateral actuation via lines 69, 70, meaning that the piston rod can be actuated in the direction of extension 71 or in the direction of retraction 72, depending on the type of actuation.

The other three chambers 59, 60, 61 are actuated by a joint line 73 in such a way that a force in the direction of extension 71 is exercised on the piston rod 57. The three lines 69, 70, 73 are actuated by three multiple-way valves 74, 75, 76, which are triggered by the control unit 46 via the operating unit 48.

All the pistons 65 to 68 and correspondingly also the chambers 58 to 61 have an identical diameter; the pressure of the compressed air that is admitted via the valves 74 to 76 is the same so that, depending on actuation, the same force is exercised on the piston rod 57 by each actuated piston 65 to 68. Consequently, a force of extension of on the whole four steps that is exercised on the piston rod 57 in the direction of extension 71, and thus a cutting power that is exercised on the knives 26 and 26', is effected in steps of 25, 50, 75 and 100 percent of the maximally possible force of extension. This takes place as follows:

Upon action on only the piston 65 via the line 70 and the valve 75, the piston rod 57 is actuated in the direction of extension 71 by 25 percent of the maximally possible force of extension.

Upon action on the pistons 66, 67, 68 and upon simultaneous action on the piston 65 via the line 69 and the valve 74, the piston rod 57 is actuated in the direction of extension 71 by 50 percent of the maximally possible force of extension. This results from the fact that, by action on the piston 65 via the line 69, a counteracting force is exerted on the piston rod 57 in the direction of retraction 72, partially compensating the forces that act on the pistons 66, 67, 68 in the direction of extension 71.

If only the pistons 66, 67, 68 are actuated via the line 73 and the valve 76, then a force acts on the piston rod 57 in the direction of extension 71, amounting to 75 percent of the totally possible force of extension.

If the piston 65 is actuated via the line 70 and the multiple-way valve 75 and the pistons 66 to 68 are simultaneously actuated via the line 73 and the valve 76, then 100 percent of the overall possible force of extension act on the piston rod 57.

For retraction of the piston rod 57 i.e., for lifting the knife 26, 26' off the anvil 18 after a cutting operation, solely the piston 65 is actuated via the line 69 and the valve 74, the two other lines 70, 73 are evacuated.

Figure 13:
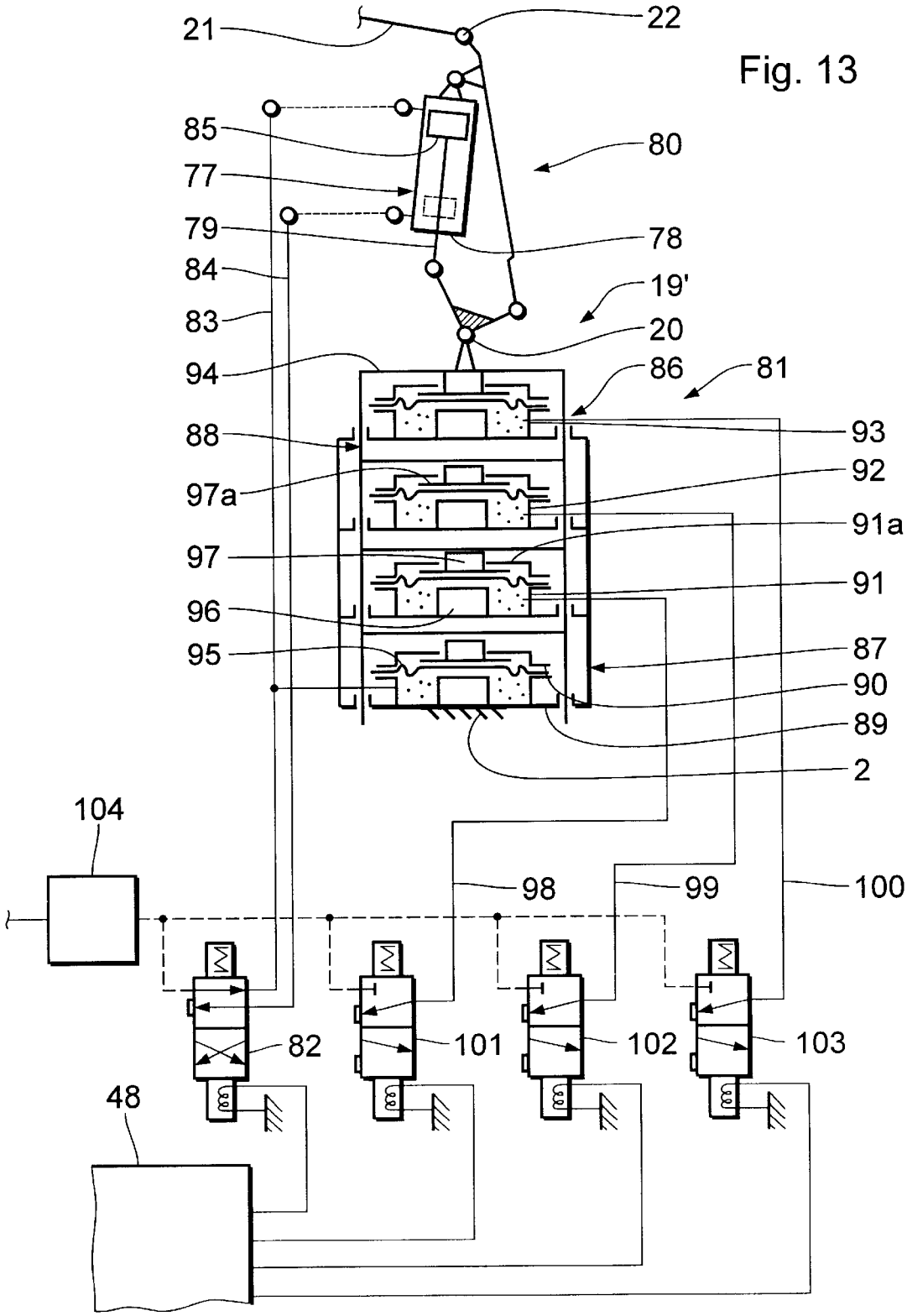
FIG. 13 is a diagrammatic view of another embodiment of the cutting drive of the buttonhole cutting device, including the linkage in circuit with the control unit.

In keeping with the alternative of the cutting drive 19' according to FIG. 13, provision is made for a piston-cylinder drive 77 that is pneumatically actuated bilaterally and the cylinder 78 and piston rod 79 of which are incorporated in a toggle mechanism 80. This toggle mechanism 80 is linked with the lever 21 by the joint 22 and supported on a force limiter 81 by the joint 20. The cylinder 78 is connected by way of a multiple-way valve 82 and two lines 83, 84 which discharge into the cylinder 78 at both ends of the piston 85 of the drive 77. Depending on the actuation of the piston 85 via one of the lines 83 or 84, the lever 21 is pivoted such that the cutting drive 19' makes a cutting motion of the knife 26 and 26' or returns the knife 26, 26' into its upper position of rest. Upon action on the piston 85 via the line 83, the toggle mechanism 80 takes its expanded position, which results in a cutting motion whereas, upon actuation of the line 84, the knife 26, 26' is again lifted into its upper position of rest.

Limiting the force that acts on the lever 21 and the knife 26 and 26' takes place by the force limiter 81 which comprises a four-storey abutment 86 that supports itself stationarily i.e., immovably, in the base plate 2 by means of a stationary part 87. The stationary part 87 of the abutment 86 bears a resilient part 88 which the toggle mechanism 80 supports itself on by the joint 20. The stationary part 87 is designed in the way of a frame, having four pneumatically actuated diaphragm cylinders 90, 91, 92, 93 one on top of the other as passive linear drives. The resilient part 88 of the abutment 86 also has intermediate bottoms 94 one on top of the other, one intermediate bottom 94 at a time being disposed above an intermediate bottom 89. The diaphragm cylinders 90 to 93 are disposed in each case on an intermediate bottom 89 and below an intermediate bottom 94. Each diaphragm cylinder 90 to 93 has an internal stop 96 below its diaphragm 95 i.e., in the interior. An external stop 97 is mounted on the diaphragm 95. The respective external stop 97 can be moved vertically by the respective diaphragm 95.

In an unpressurized condition, the diaphragms 95 are in contact with the internal stops 96 whereas, upon actuation by compressed air, the external stops 97 bear by an edge 97*a* against a diaphragm cylinder cover 91*a*. Dimensioning is such that each diaphragm cylinder can perform only a short lifting motion of for example one to two millimeters.

Compressed air is admitted to the diaphragm cylinders 91, 92, 93 via lines 98, 99, 100 via multiple-way valves 101, 102, 103. The diaphragm cylinder 90 is connected to the line 83 that acts on the drive 77.

Depending on whether, upon action on the drive 77 in the cutting direction, only the simultaneously actuated diaphragm cylinder 90 is actuated or another one or two or three diaphragm cylinders 91 to 93, an abutment force is exercised via the joint 20 on the toggle mechanism 80, amounting to 25, 50, 75 or 100 percent of the maximally possible abutment force. This again limits the force exercised on the lever 21.

The range of forces applied can be given by a pressure regulator 104 which is also triggered via the operating unit 48. A similar pressure regulator may of course also be provided in the exemplary embodiment according to FIG. 12. In the embodiment according to FIG. 13, triggering the valves 82, 101, 102, 103 also takes place by way of the operating unit 48.

The purpose of force graduation resides in adaptation of the cutting device 16 to varying cutting conditions that are influenced by the hardness and type of work piece, the number of work piece layers that are to be cut, but also by the shape and/or size of the incision to be performed. In conclusion, adaptation of the cutting force helps create a flexible cutting device 16 which can be adapted to the cutting conditions and in which the knife 26, 26' and anvil 18 are protected against unnecessary wear by too high cutting forces, this meaning a considerable increase in readiness for service.

What is claimed is:

1. A buttonhole sewing machine, comprising a needle (7) which is drivable in up and down reciprocation;

an x-y table (8), which is displaceable by an x drive (9) in an x direction and by a y drive (10) in a y direction, and which supports at least a work piece clamp (12*a*, 12*b*); and a buttonhole sewing device (16), which is substantially disposed downstream of the needle (7) in the y direction, which comprises a cutter (17) with a knife (26, 26'), which comprises a cutting block unit of several cutting blocks (42, 43), one of which at a time being movable into a position of cooperation with the knife (26, 26'), and which is provided with a cutting drive (19, 19');

wherein an anvil (18) which supports at least two cutting blocks (42, 43) that are adjustable in the x direction is stationarily joined to the sewing machine; and wherein the knife (26, 26') is movable from above against the anvil (18).

2. A buttonhole sewing machine according to claim 1, wherein the cutting blocks (42, 43) are designed for displacement in the x direction by a displacement drive (34) which is integrated in the anvil (18).

3. A buttonhole sewing machine according to claim 1, wherein the cutting blocks (42, 43) are disposed on a support (30) which is displaceably disposed on a base body (29) of the anvil (18).

4. A buttonhole sewing machine according to claim 2, wherein the displacement drive (34) is a pneumatically actuated piston-cylinder drive.

5. A buttonhole sewing machine according to claim 1, wherein the knife (26, 26') comprises a straight cutting edge (27) and an eye cutting edge (28') at one end thereof.

6. A buttonhole sewing machine according to claim 5, wherein the knife (26') comprises another eye cutting edge (28') at the other end of the straight cutting edge (27).

7. A buttonhole sewing machine according to claim 3, wherein the cutting blocks (42, 43) are detachably and replaceably mounted on the support (30).

8. A buttonhole sewing machine according to claim 1, wherein the knife (26, 26') is pressed by variable force against the anvil (18).

9. A buttonhole sewing machine according to claim 8, wherein the cutting drive (19, 19') is designed for stepwise action.

10. A buttonhole sewing machine according to claim 2, wherein the cutting blocks (42, 43) are disposed on a support (30) which is displaceably disposed on a base body (29) of the anvil (18).

* * * * *